US006638090B2

(12) United States Patent
Wakata

(10) Patent No.: US 6,638,090 B2
(45) Date of Patent: Oct. 28, 2003

(54) WATERPROOF CONNECTOR USED FOR A FLEXIBLE FLAT CABLE

(75) Inventor: Shigekazu Wakata, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/066,669

(22) Filed: Feb. 6, 2002

(65) Prior Publication Data

US 2002/0115328 A1 Aug. 22, 2002

(30) Foreign Application Priority Data

Feb. 16, 2001 (JP) ..... 2001-039544

(51) Int. Cl.[7] ..... H01R 13/52

(52) U.S. Cl. ..... 439/271; 439/135; 439/499; 439/492; 439/495; 439/521

(58) Field of Search ..... 439/493–496, 439/499, 271–275, 352, 135, 136, 137, 138, 147, 587, 521, 519

(56) References Cited

U.S. PATENT DOCUMENTS 3,366,919 A * 1/1968 Gammel, Sr. et al. ..... 439/271
4,188,086 A * 2/1980 Inouye et al. ..... 439/495
4,217,019 A * 8/1980 Cameron ..... 439/138
4,695,925 A * 9/1987 Kodai et al. ..... 439/131
4,715,827 A * 12/1987 Furman ..... 439/275
5,037,319 A * 8/1991 Hatagishi ..... 439/137
5,716,224 A * 2/1998 Masuda et al. ..... 439/138
5,716,229 A * 2/1998 Loder et al. ..... 439/495
5,895,280 A * 4/1999 Buss et al. ..... 439/271
5,906,499 A * 5/1999 Sikora et al. ..... 439/272
5,944,553 A * 8/1999 Yasui et al. ..... 439/495

FOREIGN PATENT DOCUMENTS

JP 2000-58185 2/2000

* cited by examiner

*Primary Examiner*—P. Austin Bradley
*Assistant Examiner*—Briggitte R. Hammond
(74) *Attorney, Agent, or Firm*—Banner & Witcoff, Ltd.

(57) ABSTRACT

The invention provides a miniaturized and simplified connector for a flexible flat cable. A male connector 12 is formed from bus bars B and a male housing 13, the bus bars B being welded to a tip end of a flexible flat cable C, the male housing 13 being molded so as to cover these bus bars B and a tip end portion of the flexible flat cable C. An opening portion 13*b* is formed in one face of the male housing 13. A female connector 17 is formed from terminal fittings 20 and a female housing 18, the terminal fittings 20 having resilient contacts 20*b* capable of resiliently making contact with the bus bars B when the connector 12 is fitted into the connector 17. A latching means 16 is provided between the female housing 18 and the male housing 13, and a waterproofing rubber ring 21 is located between an inner face of the female housing 18 and an outer face of the male housing 13.

14 Claims, 4 Drawing Sheets

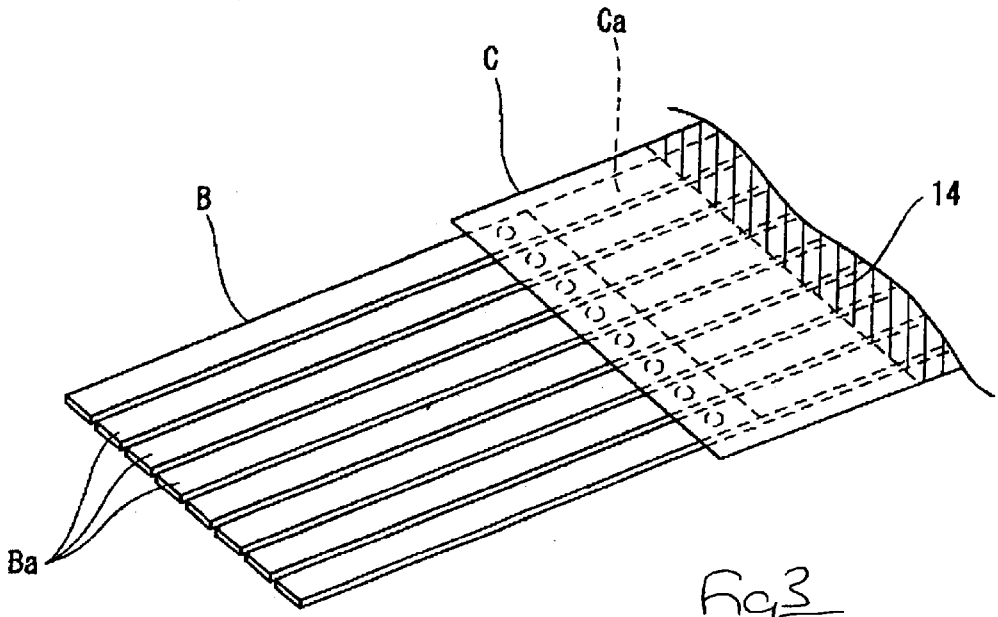
Fig3
Fig4
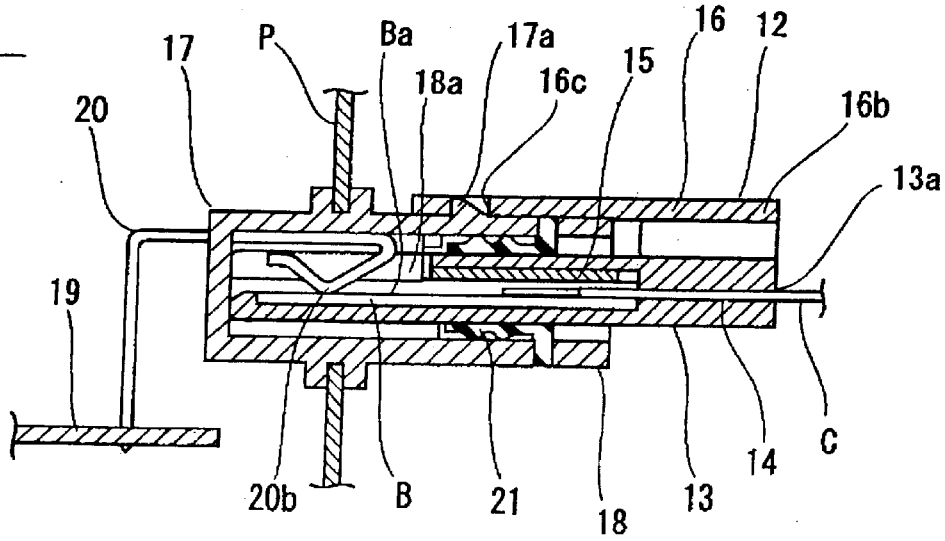

WATERPROOF CONNECTOR USED FOR A FLEXIBLE FLAT CABLE

TECHNICAL FIELD

The present invention relates to a waterproof connector used for a flexible flat cable.

BACKGROUND TO THE INVENTION

One example of a conventional waterproof connector attached to a flexible flat conductor of a flat cable, an FPC (flexible printed circuit), or the like, is described in JP-2000-58185. As shown in FIG. 7 of this specification, this waterproof connector 1 is formed from an FPC 3 having ends of terminal fittings 2 attached thereto, a housing main body 4 having an opening 4*a* via which the terminal fittings 2 are inserted, and a cover 5 which covers the opening 4*a*. A sealing member 6 is inserted between the housing main body 4 (this gripping the FPC 3) and the cover 5, thereby waterproofing the housing main body 4.

In the waterproof connector 1 described above, the terminal fittings 2 at the tip of the FPC 3 are those used to join conventional connectors. Moreover, the corresponding connector, to which the connector used for the FPC is fitted, as well as the waterproofing configuration, have configurations identical to those of conventional connectors used for electric wires. Consequently, the connector used for the FPC has the problem of being large in size. Furthermore, the waterproofing configuration for the installed portion of the FPC 3 consists of inserting the sealing member 6 between the housing main body 4 and the cover 5. This configuration is complex.

The present invention has taken the above problem into consideration, and aims to miniaturise, and present a simpler configuration for, a waterproof connector used for a flexible flat cable.

SUMMARY OF THE INVENTION

According to the invention there is provided a waterproof connector assembly of a flexible flat electrical cable, the assembly comprising,

- a male connector having a terminal electrically connected to a flexible flat electrical cable and a male housing moulded over said terminal and an adjacent portion of said cable, and said male housing having an opening to reveal said terminal,
- a female connector having a resilient contact within a female housing, said female housing defining a mouth to receive said male housing and whereby said resilient contact may electrically connect with said terminal via said opening,
- releasable latching means to maintain said male and female connector in engagement, and an annular seal adapted to seal between the inside of said mouth and the outer surface of said male housing to the rear of said opening.

Such an arrangement is suitable for particularly thin connector which is completely sealed against ingress of water.

Preferably a door is provided to close said opening, and which is opened on connection of the male and female connectors, preferably by abutment of the female housing. Such a door may include a releasable abutment for contact with the male housing, so as to avoid accidental opening thereof prior to coupling of the connector assembly.

BRIEF DESCRIPTION OF DRAWINGS

Other features of the invention will be apparent from the following description of several preferred embodiments shown by way of example only in the accompanying drawings in which:

FIG. 3 is a diagonal view showing joining portions of a flexible flat cable and bus bars.

FIG. 4 is a cross-sectional view showing a fitting state of the male connector and a female connector.

DESCRIPTION OF PREFERRED EMBODIMENTS

Figure 1:
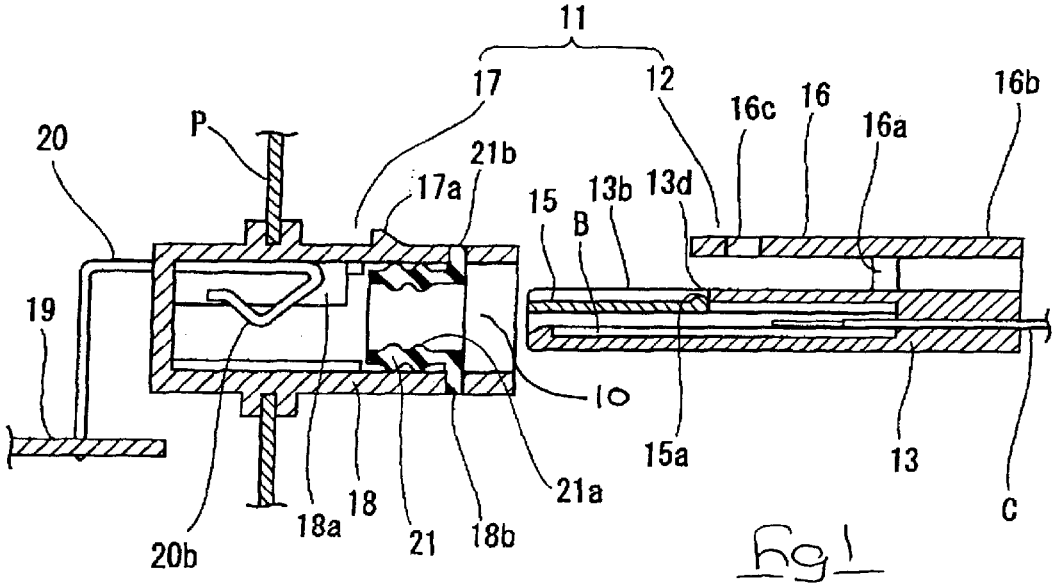
FIG. 1 is a cross-sectional view showing a waterproof connector of a first embodiment of the present invention.
Figure 2:
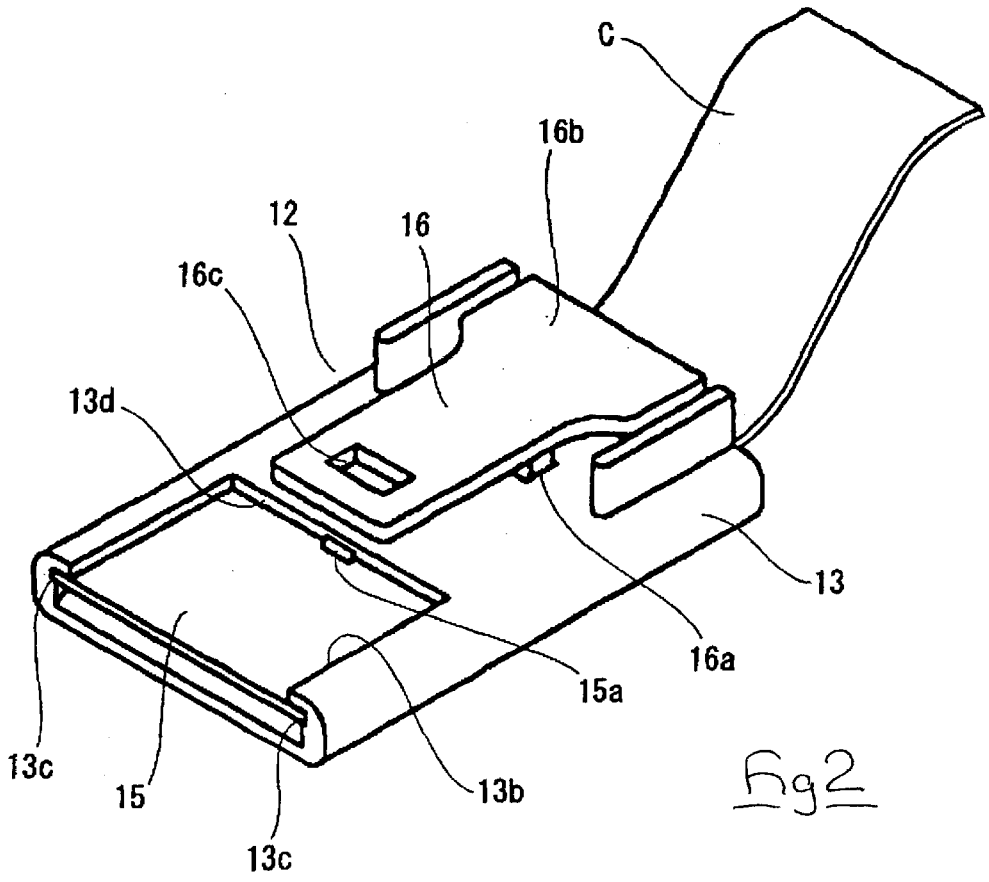
FIG. 2 is a diagonal view showing a male connector.

Embodiments of the present invention are described below with the aid of figures. A first embodiment of a waterproof connector of the present invention is shown in FIGS. 1 to 4. This waterproof connector 11 has: a male connector 12, into which a flexible flat cable C, such as an FPC, a flat cable, etc., is installed; and a female connector 17, this being attached or part of a device. The male connector 12 is fitted into a mouth 10 of the female connector 17.

The male connector 12 is formed from bus bars B made from metal sheets which join with a tip of the flexible flat cable C, and a male housing 13 which is formed by moulding and is made of plastic. The male housing 13 has a flat and thin shape, and covers the bus bars B and an end portion of the flexible flat cable C. Before the male housing 13 is moulded, the plurality of aligned bus bars B are unified, by welding, with a plurality of conducting members Ca aligned at the tip portion of the flexible flat cable C (see FIG. 3). Then adhesive 14 is spread on the tip portion of the flexible flat cable C, and the bus bars B and the tip portion of the flexible flat cable C is placed within the mould for moulding the male housing 13, the moulding operation enclosing the tip portion of the flexible flat cable C that is joined with the bus bars B.

The adhesive 14 is spread on an inserting portion 13*a*. Consequently, the interior of the male housing 13 is waterproofed reliably. Furthermore, the bus bars B are installed as far as an anterior tip of the male housing 13, an opening portion 13*b* at an upper face of the male housing 13 causing contacting surfaces Ba at upper faces of these installed bus bars B to be exposed. A separate cover 15 is provided so as to cover the opening portion 13*b*, and guiding grooves 13*c* are provided in inner walls of both sides of the opening portion 13*b*, the cover 15 being fitted therewith in a manner whereby it can slide in the fitting direction of the female connector 17, thereby allowing the opening portion 13*b* to be open or closed. Moreover, a stopper 15*a* protrudes at an inwards location of an upper face of the cover 15, this engaging with an inner opening edge 13*d* of the opening portion 13*b* when the cover 15 is in a closed state. This stopper 15*a* maintains the cover 15 in the closed state before the male connector 12 is fitted to the female connector 17, the engaged state of the stopper 15*a* being released when the tip edge of the cover 15 is pushed.

A locking arm 16 protrudes at a posterior portion of the upper face of the male housing 13. A central portion of the locking arm 16 forms a fulcrum 16*a* that allows the locking arm 16 to move resiliently in the manner of a see-saw. A posterior end portion of the locking arm 16 forms an operating member 16*b*, and an anterior end portion thereof is provided with an engaging hole 16*c*. Pressing the operating member 16*b* causes the anterior end of the locking arm 16 to move upwards, this allowing the engaging hole 16*c* to be released from an engaged state with an engaging protrusion 17*a* of the female connector 17 (to be described).

The female connector 17 is formed from terminal fittings 20 and a hood-shaped female housing 18 that is attached to a panel P of a device. One end of each of the terminal fittings 20 is installed within the female housing 18, the other end thereof joins with a base 19. A plurality of these terminal fittings 20 are provided in a manner whereby they correspond to the alignment of the bus bars B. The end of each terminal fitting 20 that is installed within the female housing 18 is provided with a resilient contact 20*b*. This resilient contact 20*b* is folded downwards in a bent-over shape and is capable of making resilient contact with the upper face of the bus bar B when the male connector 12 has been fitted into the female connector 17. An abutment 18*a* protrudes within the interior of the female housing 18, this making contact with the cover 15 while the male housing 12 is being fitted, and causing the cover 15 to move in its direction of opening.

The engaging protrusion 17*a* protrudes from an upper portion of an outer face of the female housing 18. This engaging protrusion 17*a* engages with the engaging hole 16*c* of the locking arm 16 when the male connector 12 is fitted, thereby preventing this male connector 12 from moving in a direction of removal. The engaging hole 16*c* and the engaging protrusion 17*a* serve as a latching means to maintain the male connector 12 and the female connector 17 in a fitted state. Furthermore, a waterproofing rubber ring 21 is provided along an inner circumference of the female housing 18, this fitting tightly between this inner circumference and an outer circumference face of the male housing 13 when the male connector 12 is fitted. A plurality of protruding ridges 21*a* are formed along an inner and an outer circumference of the waterproofing rubber ring 21, and a retaining protrusion 21*b* thereof fits into a retaining hole 18*b* formed in an outer circumference of the female housing 18, thereby fixing the waterproofing rubber ring 21 to the female housing 18.

In the waterproof connector 11 configured as described above, when the male connector 12 is inserted into the female connector 17, first the inner edge portion of the cover 15 (which is covering the opening portion 13*b* of the male housing 13) makes contact with the abutment 18*a* within the female housing 18, this abutment 18*a* moving the cover 15 in the direction opposite the fitting direction. As a result, the opening portion 13*b* is opened, and the upper faces of the bus bars B are exposed. At this time, the resilient contacts 20*b* of the terminal fittings 20 make contact with the corresponding contacting members Ba of the bus bars B, thereby causing electrical contact between the male connector 12 and the female connector 17. The male housing 13 and the female housing 18 are fitted together, being maintained in a fully waterproofed state by the waterproofing rubber ring 21. A tip end portion of the locking arm 16 rises over the engaging protrusion 17*a* of the female connector 17, and the engaging hole 16*c* thereof engages with the engaging protrusion 17*a*, thereby maintaining the two connectors 12 and 17 an unremovable state. Further, when the male connector 12 is to be removed from the female connector 17, the operating member 16*b* of the locking arm 16 is pressed downwards, releasing the engaging hole 16*c* from its engaged state with the engaging protrusion 17*a*. Then the male connector 12 can easily be removed by being pulled.

Figure 5:
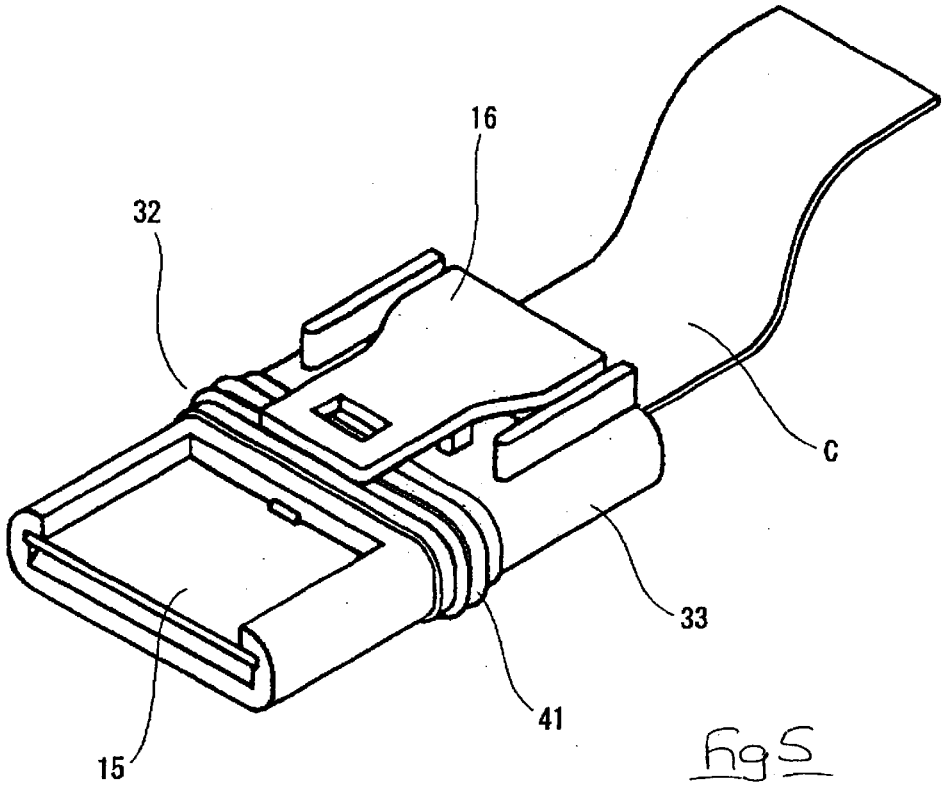
FIG. 5 is a diagonal view showing a male connector of a second embodiment.
Figure 6:
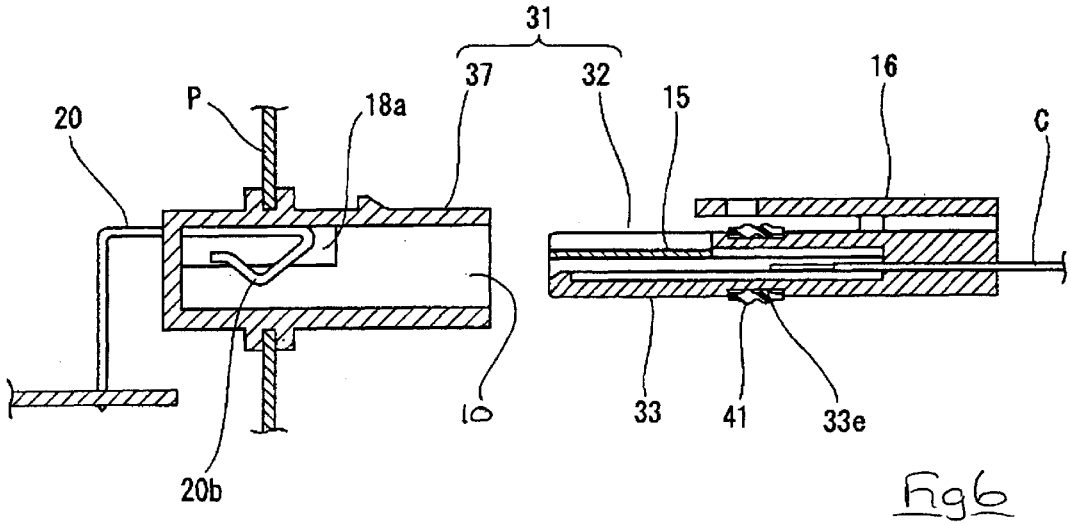
FIG. 6 is a cross-sectional view showing a fitting state of the male connector of the second embodiment and a female connector.
Figure 7:
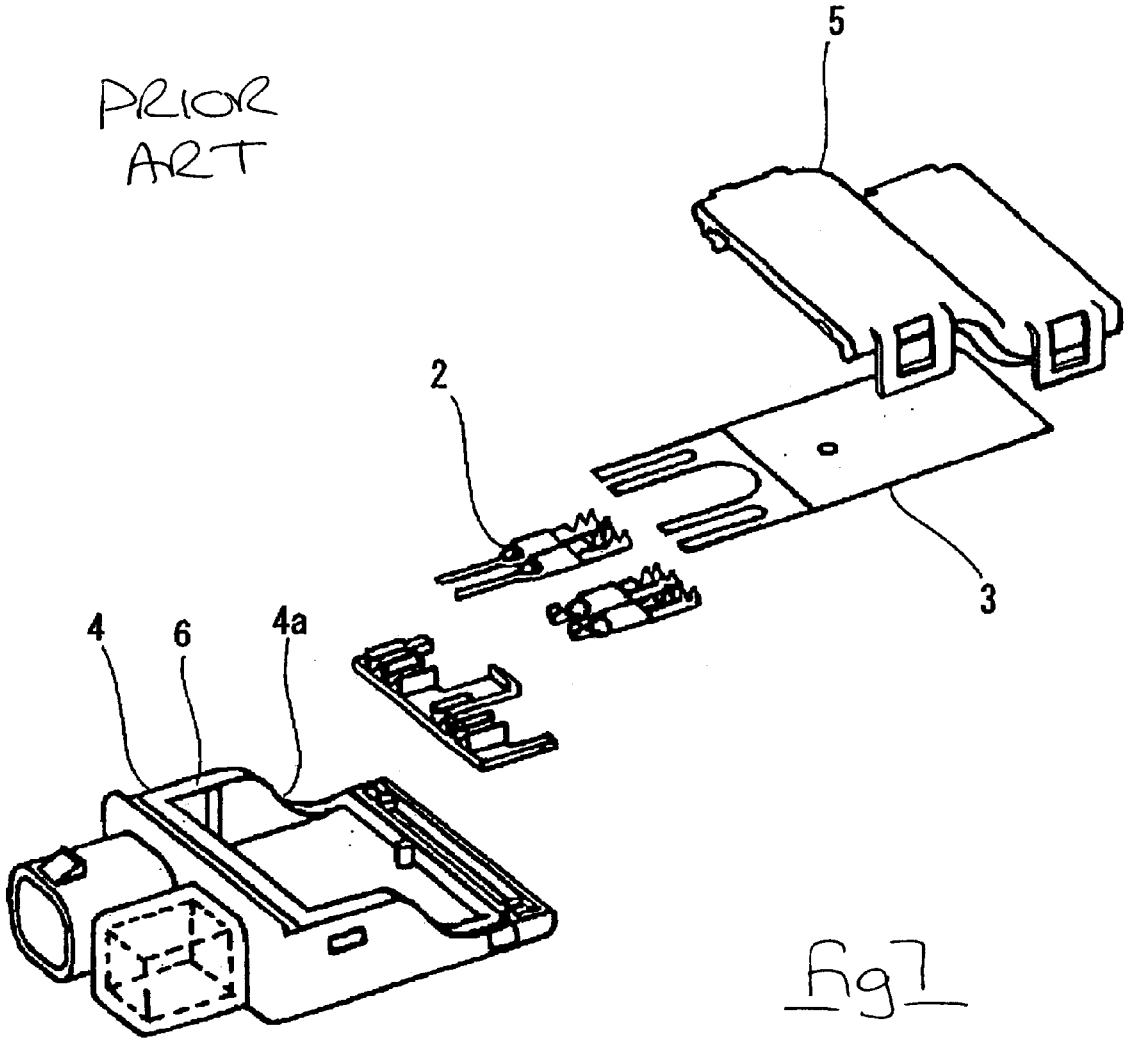
FIG. 7 is a view of a prior art example.

A second embodiment of a waterproof connector 31, is shown in FIGS. 5 and 6. In this embodiment, a waterproofing rubber ring 41 is fitted into a circumference groove 33*e* formed in an outer circumference of a male housing 33. An outer circumference of this waterproofing rubber ring 41 fits tightly with an inner circumference of a female housing 38 when a male connector 32 is fitted to a female connector 37. In this manner, the waterproofing rubber ring 41 can easily be attached to the male housing 33. Furthermore, the remaining components are the same as in the first embodiment. Consequently, the same numbers are assigned thereto, and an explanation thereof is omitted.

In the embodiments described above, a connector is described which is used for a machine and wherein the female connector 17 or 37 is attached to the panel P. However, a simple connector may equally well be used. Further, the above embodiments describe a case whereby the adhesive 14 is located between the end portion of the flexible flat cable C and the male housing 13 or 33. However, the male housing 13 or 33 may equally well cover the flexible flat cable C directly.

What is claimed is:

1. A waterproof connector assembly of a flexible flat electrical cable, the assembly comprising, a male connector having a terminal electrically connected to a flexible flat electrical cable and a male housing moulded over said terminal and an adjacent portion of said cable, and said male housing having an opening to reveal said terminal, a female connector having a resilient contact within a female housing, said female housing defining a mouth to receive said male housing in a fitting direction and whereby said resilient contact may electrically connect with said terminal via said opening and the opening opens toward an outer surface of the male housing in a direction perpendicular to the fitting direction, releasable latching means to maintain said male and female connector in engagement, and an annular seal adapted to seal between the inside of said mouth and the outer surface of said male housing to the rear of said opening.

2. An assembly according to claim 1 wherein said seal is around said male housing and located in a peripheral groove thereof.

3. An assembly according to claim 1 wherein said seal is mounted within said mouth by peripheral protrusions of said seal.

4. An assembly according to claim 1 and further including an adhesive sealant at the interface between said flat cable and male housing.

5. An assembly according to claim 1 and further including a door for said opening.

6. An assembly according to claim 5 wherein said door is slidable in a direction opposite to the fitting direction of said male connector in said female connector.

7. An assembly according to claim 6 wherein said door is slidable to the interior of said male housing.

8. An assembly according to claim 4 and further including a door for said opening.

9. An assembly according to claim 8 wherein said door is slidable in a direction opposite to the fitting direction of said male connector in said female connector.

10. An assembly according to claim 9 wherein said door is slidable by atubment with said female housing.

11. An assembly according to claim 6 wherein said door is slidable by abutment with said female housing.

12. An assembly according to claim 11 wherein said door is slidable to the interior of said male housing.

13. An assembly according to claim 1 and comprising a plurality of terminals and a respective plurality of contacts.

14. An assembly according to claim 13 wherein said terminals comprise parallel elongate flat members aligned in the fitting direction of said male and female connector.

* * * * *